United States Patent [19]

Hellerman et al.

[11] 4,023,270

[45] May 17, 1977

[54] CUTTER WITH WIRE CATCH

[76] Inventors: James Robert Hellerman, 12622 Elizabeth Way, Tustin, Calif. 92680; Ronald Daniel White, 6466 Saipan, Cypress, Calif. 90630; Harold Dwaine Palmer, 25942 Corriente Lane, Mission Viejo, Calif. 92675

[22] Filed: May 20, 1976

[21] Appl. No.: 688,201

[52] U.S. Cl. ..... 30/124

[51] Int. Cl.[2] ..... B26B 17/04

[58] Field of Search ..... 30/123, 124, 134, 135; 76/104 A

[56] References Cited

UNITED STATES PATENTS 410,375 9/1889 Norrell ..... 30/135

2,553,697 5/1951 Zacrep ..... 30/135

FOREIGN PATENTS OR APPLICATIONS 1,443,560 5/1966 France ..... 30/124

*Primary Examiner*—Al Lawrence Smith
*Assistant Examiner*—J. C. Peters
*Attorney, Agent, or Firm*—Knobbe, Martens, Olson, Hubbard & Bear

[57] ABSTRACT

A springy one-piece wire element is mounted on one arm of a wire cutter to hold a section of wire as it is clipped from a main wire. The wire element has a U-shaped portion which grips the cutter arm and holds a catch portion of the wire element adjacent the cutting edge to cooperate with the other cutter arm to hold the clipped wire section.

9 Claims, 5 Drawing Figures

CUTTER WITH WIRE CATCH

This invention relates to wire cutters and more particularly to an improved means for catching or holding a section of wire as it is clipped from a main wire.

In cutting a small section of wire from a larger piece, the small section will often fly through the air at rapid speed. This is a safety hazard in that a person could be injured by such particle, particularly if it should strike a person in the eye or ear. This is a severe problem in te electronics industry where large numbers of people may be sitting close to each other each cutting wires in connection with manufacturing electronic assemblies. In the United States, these hazards have been recognized by government and hence, requirements exist for taking necessary safety precautions.

A simple way of solving this problem is to provide means on each wire cutting tool which has the capability to catch the small wire particle being cut from a larger wire. Some such wire catches have already been made available. However, the known designs are not very versatile, being limited to specific types of cutters which represent a small segment of the market. Accordingly, a need exists for an improved wire catch which is adapted for use on the majority of cutters currently being used, and which is effective, durable and inexpensive.

In accordance with the present invention, an improved wire catch is provided which is basicly a springy one-piece wire element which is clamped to one of a pair of pivoted cutter arms or members of a conventional wire cutting tool. The wire element includes a catch portion which engages the inner side of the one cutter member and extends generally parallel to and adjacent the cutting edge of the jaw portion of the cutter member. The element further includes a retaining tang which engages the outer side of the one cutter member. The portion of the wire element between the catch portion and the tang is positioned and dimensioned so that the springiness of the wire element urges the catch portion and the tang against opposite sides of the one cutter member and holds the catch portion adjacent the cutter edge in position to catch or hold a section of wire as it is clipped. It does this in cooperation with the cutting edge of the other cutter member jaw.

In a preferred form of the invention, the portion of the wire element between the catch portion and the tang includes a U-shaped portion which extends along one of the cutter members with the closed end of the U-shaped portion clamped to the cutter member. In this way, the open ends of the U-shaped portion can be spread slightly in positioning the tang on one side of the cutter member and the catch portion on the other side. The resiliency or springiness of the wire element holds the catch portion in the proper position adjacent the cutter edge. A heat-shrinkable sleeve or band is preferably used to clamp the wire edment to the cutter in that it is a reliable and inexpensive approach that can be used by the user of the cutter or by the cutter manufacturer.

For a more detailed understanding of the invention, refer now to the following detailed description and drawing in which.

Figure 1:
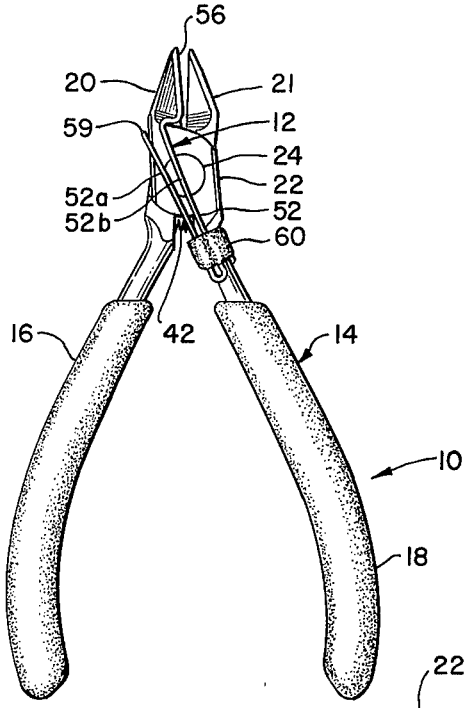
FIG. 1 is a plan view of a wire cutter incorporating the wire catch of the invention.
Figure 2:
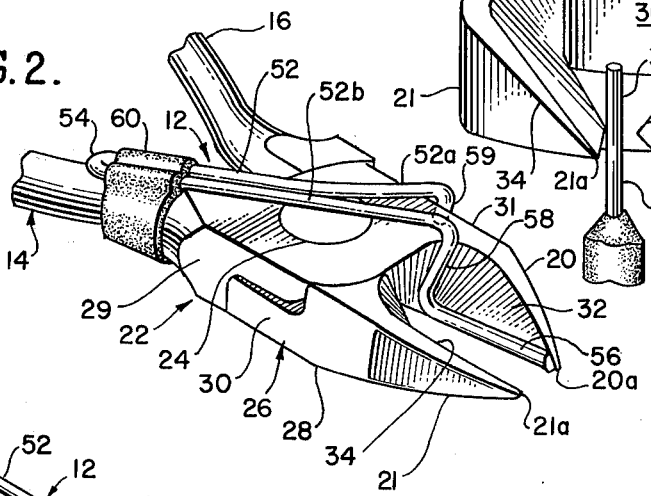
FIG. 2 is an enlarged perspective view of the jaw end of the cutter of FIG. 1 illustrating the construction of the wire catch of the invention.

Referring now to FIG. 1, the wire cutter 10 minus the wire catch 12 of the invention, is a conventional wire cutter having a pair of pivoted cutter arms or members 14 and 16. As can be seen, each cutter member includes a handle portion 18 and a cutting jaw portion 20 on opposite sides of a mid-section 22 through which a pivot pin 24 extends. For the cutter shown, the mid sections of the members are machined to fit together to provide a generally rectangular configuration with one cutter member 14 having a flat mid-section 22 forming the top of the cutter and the other member 16 having a flat section 28 forming the bottom. As seen in FIG. 2, each of the mid-sections 22 and 26 have mating side wall portions 29 and 30 which are generally perpendicular to the larger flat, top and bottom walls.

Figure 4:
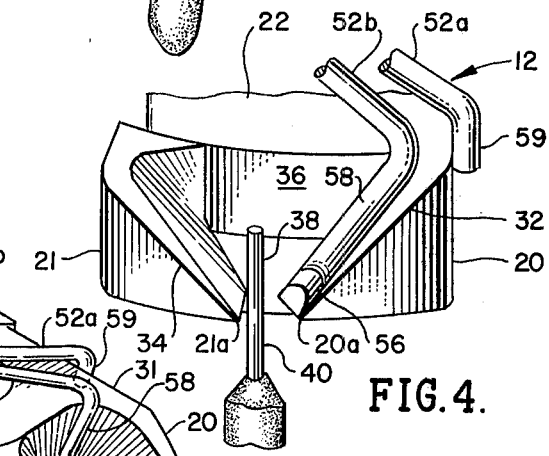
FIG. 4 is another perspective view of a portion of the cutter shown in FIGS. 1 and 2 but with a piece of wire about to be severed by the cutter.
Figure 5:
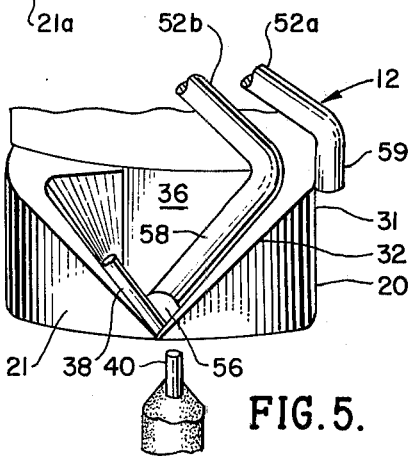
FIG. 5 is a perspective view similar to FIG. 4 showing the cut section of wire held by the wire catch.

As may be further seen, each jaw portion 20 and 21 has a mating cutting edge 20*a* and 21*a* which extends near the lower side of the cutter members and slopes forwardly and upwardly from the mid-sections 22 and 26. The inner sides 32 and 34 of the cutter jaws 20 and 21 slope upwardly and outwardly away from the cutting edges 20*a* and 21*a*to define a somewhat cone shaped or pyramid shape pocket 36. In use, a wire to be cut is normally inserted or positioned so that the small piece 38 to be cut from a larger wire 40 extends upwardly into the pocket as illustrated in FIGS. 4 and 5. A coil spring 42, FIG. 1, extends between the ends of the handle portions 18 of the cutter members 14 and 16 adjacent the mid-sections 22 and 26 to hold or bias the cutter jaws 20 and 21 apart.

The wire catch 12 of the invention comprises a springy one-piece wire element which includes an elongated U-shaped portion 52 which, as may be seen from FIGS. 1 and 2, extends along the flat mid-section 22 of one of the cutter arms 14 and 16 with the closed end, or bight 54 of the U-shaped portion extending on one side of the pivot and the open legs 52*a* and 52*b* of the U-shaped portion 52 extending across the pivot 24 and terminating on its other side. The closed end of the U-shaped portion is clamped to the handle 18 of cutter member 14 by suitable means so that the spring is held in cantilever fashion, permitting the open legs of the U-shaped portion to be flexed away from each other.

While the wire element 12 may be clamped to the cutter member by any suitable means, a preferred advantageous approach is illustrated. The catch 12 is positioned on the cutter and temporarily held in place by a rubber band or elastic around the cutter mid-section and then permanently held in place by a single band 60 made of heat shrinkable material. Before being heated, the band 60 is larger in diameter and may be simply slipped over the end of the cutter member handle 18 and around the closed end 54 of the U-shaped portion 52. When the band 60 is subjected to the heat, it shrinks and becomes rigid, thus, securely clamping the wire catch 12 in a reliable and inexpensive manner. A type of heat shrinkable sleeve 60 that is particularly convenient is one having an inner wall that melts and conforms to the shape of the wire element 12 and the cutter arm 14 at a temperature slightly lower than the temperature at which the outer wall of shrinkable material shrinks. This insures tight clamping of the catch 12. Such material is commercially available from Raychem Corporation, 300 Constitution Drive, Menlo Park, California 94025, identified as SCL heat shrinkable tubing made of radiation crosslinked polyolefins. The product is normally used for electrical applications wherein the inner wall is to form a sealing function so that a component can be encapsulated in one step. Another advantage of using the heat shrinkable sleeve 60 for clamping the catch 12 is that this method is easy to perform so that the catch 12 can be added to existing cutters by the customer or user of the tool, as well as by a tool manufacturer.

As may be seen from the drawings, the wire catch 12 includes a catch portion 56 which extends into the pocket 36 and extends generally parallel to the cutting edge 20*a* of the cutter member to which the element is attached. The catch portion 56, particularly its forward tip, engages the jaw 20. The catch portion 56 is positioned slightly above the cutter edge 20*a* so as not to interfere with the cutting edge 21*a* of the other jaw 21. Also, the lower and inner sides of the portion 56 are flattened so that the catch portion can be closer to the cutting edges and occupy less space. The catch portion 56 angles outwardly with respect to the leg 52*b* of the U-shaped portion 52 at an angle of about 30°. The catch portion 56 is attached to the end of the one leg 52*b* of the wire element 12 by means of a connecting section 58 which extends roughly perpendicular to the leg 52*b* and into the pocket 36 of the cutter. As may be seen from FIG. 2, the connecting portion 58 actually extends rearwardly somewhat with respect to the U-shaped portion 52 so that it forms an angle of about 80° with the leg 52*b* of the U-shaped portion 52.

Formed integral with the free end of the other leg 52*a* of the wire element 12 is a depending tang 59 which engages the outer side 31 or edge of the cutter member 14 in the area where the jaw 20 joins the mid-section 22.

Figure 3:
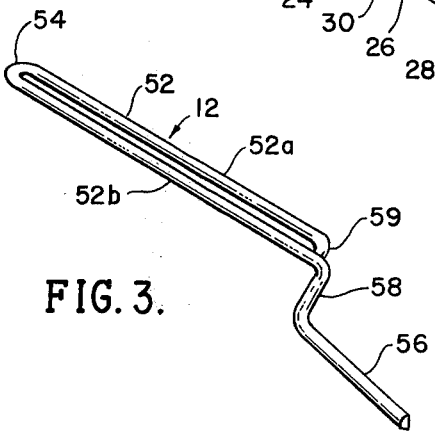
FIG. 3 is a perspective view of the wire catch separated from the wire cutter.

With the wire catch 12 in its free unbiased state as shown in FIG. 3, the legs 52*a* and 52*b* of the U-shaped portion 52 extend almost parallel to each other but with a slight outward spread. However, when the element is positioned onto the cutter member 14 into the position shown in FIGS. 1 and 2, it is necessary to slightly spread the legs of the element so that the tang 59 on one leg 52*a* engages the outer side 31 of the cutter member and the catch portion 56 on the other leg 52*b* of the U-shaped portion 52 engages the inner side of the cutter member 20 adjacent the cutting edge 20*a*. With this arrangement, the wire element 12 presses resiliently against both sides of the cutter member. Of course the band 60 holds the element downwardly onto the cutter arm 14.

FIGS. 4 and 5 illustrate the manner in which the wire catch operates. As seen in FIG. 4, the wire to be severed is simply inserted between the cutter jaws in the usual fashion. As the jaws of the cutter are closed, the catch portion 56 of the wire catch 50 engages on side of the wire 38 being cut and the catch portion 56 is pushed upwardly slightly as shown in FIG. 5. The catch portion 56 presses or holds the severed section 38 of wire 40 against the inner side 34 of the cutter jaw 21 and prevents it from flying into the air where it may injure someone.

In cutting a small section of small diameter wire, the cutting usually occurs near the tip of the cutting edges. In fact, with some cutters, the edges closer to the cutter pivot are not even sharpened. It is for this reason that it is desirable to have the catch portion 56 close to the cutting edge 20*a* near the tips of the cutting edge and the catch portion. Thus, usually the rearward section of the catch portion 56 and the connecting portion 58 are spaced slightly from the cutter member 14, thereby insuring contact at the tip. Also, since various wire cutter manufacturers have different configurations in the pocket 36, it is preferable that the catch 56 be shaped to fit all or most of them. Similarly, the cutting edges of different cutters slope at varying angles. Hence, it is convenient to have the catch portion 56 sloping upwardly, slightly away from the cutting edge 20*a* as it extends away from the tip of the cutter, making it more adaptable to various shaped cutters. This does not adversely affect performance, since normally it is only large diameter wires that are cut nearer to the pivot, and with large diameter wires, the catch portion 56 will still hold a clipped wire particle 38 when the portion 58 is spaced slightly from the cutting edge.

The wire catch material and diameter may be varied as necessary to fit the application. A wire diameter of 0.045 inches has been found to be quite satisfactory, with springiness characteristics comparable to piano wire.

What is claim is:

1. The combination of a wire cutter and a wire catch mounted on the cutter to hold a small section of wire as it is clipped from a larger section, said cutter including a pair of pivotally mounted members having handle portions and mating wire clipping jaw portions with the handle portions on one side of the pivot and the jaw portions on the other side, the improvement comprising:

a springy one-piece wire element and means for clamping the element to one of said cutter members;

said wire element having:

a. a catch portion engaging the inner side of said one cutter member and extending adjacent to the cutting edge of the jaw portion of said one cutter member, b. a retaining tang engaging the outer side of said one cutter member, and c. means between said catch portion and said tang, dimensioned and positioned so that the springiness of the wire element urges the catch portion and the tang portion against said one cutter member and retains said catch portion adjacent said cutter edge in position to hold, with the other of said cutter members, a section of wire as it is clipped, said means between the catch portion and said tang includes an elongated generally U-shaped portion which extends along said one cutter member, the open ends of said U-shaped portion being spread beyond the untensioned condition of the element to provide the springiness which urges the catch portion and the tang against opposite sides of said one cutter member.

2. The improvement of claim 1 wherein the closed end of the U-shaped portion is located on the handle side of the pivot axis for said cutter members and the open end of said U-shaped portion is on the jaw side of said pivot axis.

3. The improvement of claim 2 wherein said clamping means clamps the closed end of the U-shaped portion to said one cutter member.

4. The improvement of claim 3 wherein said clamping means comprises a heat shrinkable band which is slipped over the handle portion of said one cutter member and over the closed end of said U-shaped portion before being heat shrunk to clamp the one piece wire element against said one cutter member.

5. The improvement of claim 1 wherein the means between said catch portion and said tang includes a connecting portion connecting the free end of one leg of said U-shaped portion and one end of said catch portion, said connecting portion extending generally perpendicular to said one leg to span the distance between the free end of said one leg and the cutting edge.

6. The improvement of claim 1 wherein the portion of said cutter member engaged by said U-shaped portion is relatively flat and the outer side of said one cutter member is generally perpendicular to said flat portion, said tang being connected to the free end of one of the legs of said U-shaped portion and extending generally perpendicular to said one leg and engaging said outer side of said one cutter member.

7. The combination of:

a wire cutter including a pair of pivotally mounted members having handle portions and mating wire clipping jaw portions with the handle portions on one side of the pivot and the jaw portions on the other side;

a springy one-piece wire element; and means for clamping the element to one of said cutter members;

said wire element having:

a. a generally U-shaped portion which extends along said one cutter member, the closed end of the U-shaped portion being on the handle side of the pivot for said cutter members and the open end of said U-shaped portion being on the jaw side of said pivot, said clamp means clamping the closed end of the U-shapd portion to said one cutter member;

b. a catch portion engaging the inner side of said one cutter member and extending generally parallel to and adjacent to the cutting edge of the jaw portion of said one cutter member;

c. a portion connecting the free end of one leg of said U-shaped portion and one end of said catch portion; and d. a retaining tang integral with the free end of the other leg of said U-shaped portion engaging the outer side of said one cutter member, the open legs of said element beyond spread when positioned on said one cutter member so that the springiness of the wire element urges the catch portion and the tang portion against opposite sides of said one cutter member and retains said catch portion adjacent said cutter edge in position to hold, with the other of said cutter members, a section of wire as it is clipped.

8. A method of attaching a wire catch to a wire cutter arm, the wire catch including a portion extending along the handle of the wire cutter arm and having a wire catch portion extending adjacent to the cutting edge on said cutter arm, said method including:

positioning the wire catch onto the cutter arm;

temporarily clamping the catch in position on the arm by suitable means such as using an elastic around the catch and the arm;

slipping a heat shrinkable sleeve over the end of said cutter arm handle and into position over said portion of the wire catch extending adjacent said handle; and applying heat to the sleeve to cause it to shrink and become rigid clamping the wire catch in position.

9. The combination of a wire cutter and a wire catch mounted on the cutter to hold a small section of wire as it is clipped from a larger section, said cutter including a pair of pivotally mounted members having handle portions and mating wire clipping jaw portions with the handle portions on one side of the pivot and the jaw portions on the other side, the improvement comprising:

a springy one-piece wire element and means for clamping the element to one of said cutter members;

said wire element having:

a. one end forming a catch portion engaging the inner side of said one cutter member and extending adjacent to the cutting edge of the jaw portion of said one cutter member, b. a retaining tang formed on its other end engaging the outer side of said one cutter member, and c. a connecting portion between said catch portion and said tang clamped to said one cutter member, said connecting portion including a closed end portion and a pair of legs, one of said legs being connected to said catch portion and the other of said legs being connected to said tang, said one cutter member and said connecting portion being formed so that said legs must be spread to position said element on said one member, and the springiness of the connecting portion urges the catch portion and the tang portion against said one cutter member and retains said catch portion adjacent said cutter edge in position to hold, with the other of said cutter members, a section of wire as it is clipped.

* * * * *